US006857539B2

(12) United States Patent
Parra

(10) Patent No.: US 6,857,539 B2
(45) Date of Patent: Feb. 22, 2005

(54) BLISTER HOOK DISPLAY

(76) Inventor: Andres Horacio Ahumada Parra, Campo de Deportes 421, Nunoa, Santiago (CL)

( * ) Notice: Subject to any disclaimer, the term of this patent is extended or adjusted under 35 U.S.C. 154(b) by 0 days.

(21) Appl. No.: 10/356,726

(22) Filed: Feb. 3, 2003

(65) Prior Publication Data

US 2004/0000558 A1 Jan. 1, 2004

(30) Foreign Application Priority Data

Jun. 26, 2002 (CL) ..... 1666-2002

(51) Int. Cl.[7] ..... G07F 11/56
(52) U.S. Cl. ..... 221/25; 221/124
(58) Field of Search ..... 221/2, 3, 7, 13, 221/124, 133, 155, 127, 130, 221, 253, 25, 26

(56) References Cited

U.S. PATENT DOCUMENTS

2003/0138313 A1 * 7/2003 Monti ..... 414/796.7
2004/0050740 A1 * 3/2004 Lewis ..... 206/459.1

* cited by examiner

*Primary Examiner*—Kenneth W. Noland
(74) *Attorney, Agent, or Firm*—Jacobson Holman PLLC

(57) ABSTRACT

A blister pack hook display case with a manual security dispensing system comprised of a display case with a transparent door and lock that has a blister pack dispenser on each hook, wherein the dispenser dispenses a blister pack each time the pulley located in the front is pulled. It will dispense the chosen blister through the transparent door, which will reach the cashier for payment and withdrawal by means of a slide below; the car dispensing the blister packs has a number of blades depending on the space available and the size of the blister pack that oscillates forward only to raise the paddles when the car is released backwards without moving the next blister pack backward. They then fall into position to dispense a new blister pack. The blades do not oscillate backwards so that when it is pulled forward, the first blister pack is moved until it falls off the hook and all others then move one step forward to continue the sequence.

13 Claims, 9 Drawing Sheets

A
B
10
12
13
14
15
16

BLISTER HOOK DISPLAY

DESCRIPTION OF INVENTION

This invention provides a blister hook displayer, specifically for a manual dispenser to be handled by any user that guarantees the distributor actual payment for its products.

It is a known problem in blister-packaged product display that there is a significant number of thefts because of their easily handling, specially in stores where they are displayed for sale, such as supermarkets where there is a significant number of thefts given their easy handling.

In order to avoid this theft, varied solutions have been proposed that range from doubling up the tip of the hooks, some with price tag stops, in order to avoid massive theft off each hook. Another of the solutions is to keep the blister packs in display cases under lock and key, which necessarily implies that the user must look for a supervisor or the person who has the keys to the display case, subsequently discouraging the purchase of those products.

This has forced distributors to eliminate display cases of the products that are more appealing or saleable for thieves, who have organized into true gangs difficult to detect. Domestic and international companies who display their blister pack products have therefore suffered heavy economic losses and a significant decrease in sales.

Therefore, this invention was designed to provide an industrial solution that fulfills several requirements, namely it provides a good display of the product but the product cannot be removed directly by the user. Nonetheless, the user can choose to make his purchase and that choice does not involve either the cashier or third parties at the store or supermarket.

Nine figures of the invention are presented that reflect the ambit of protection requested:

Figures 1A, 1B:
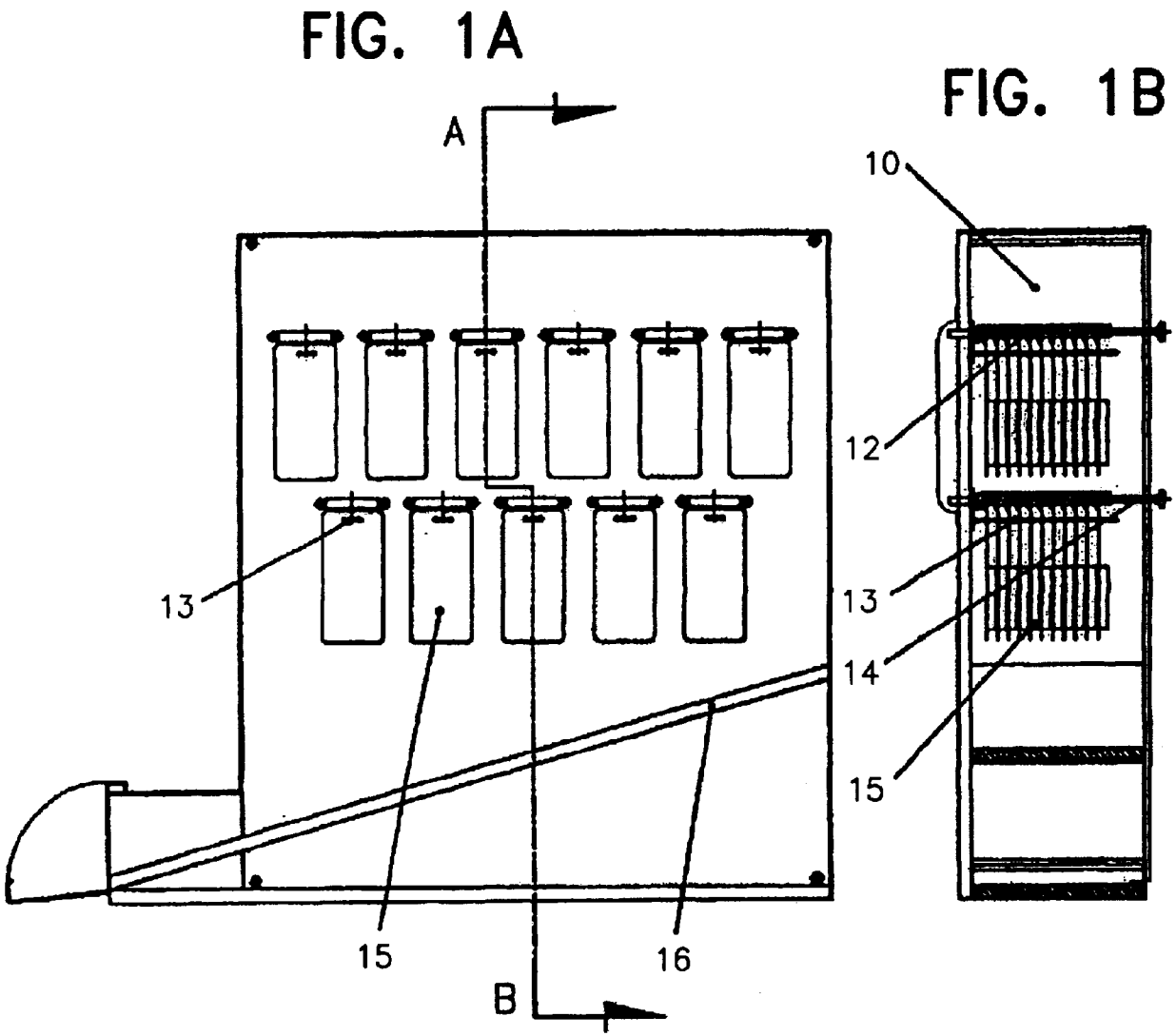
FIG. 1 represents a frontal view of the display case and section A-B.
Figures 2A, 2B:
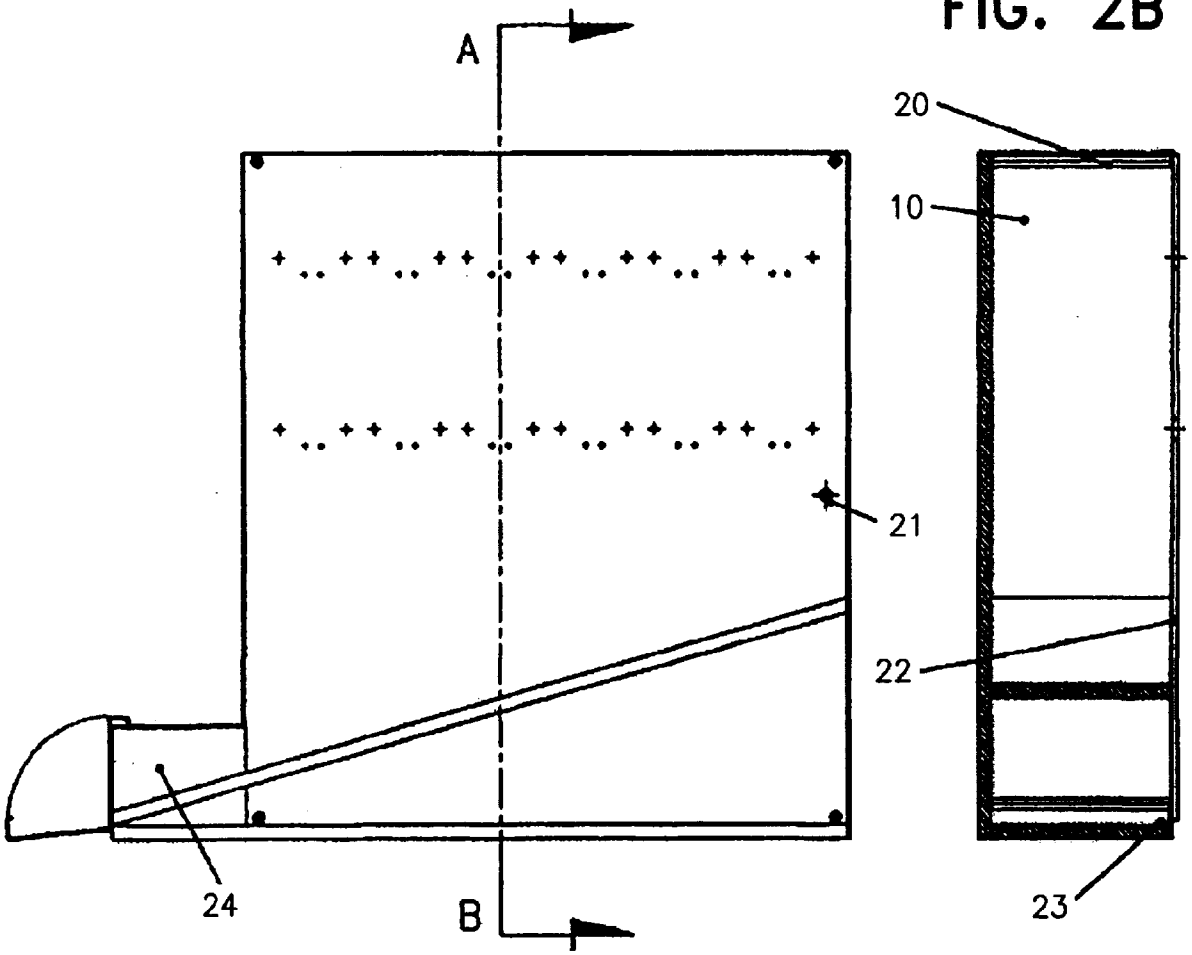
FIG. 2 represents a frontal view of the display case and section A-B, with no accessories.

In order to fulfill these needs, this invention was designed to provide a fork-hook display case (FIG. 1). This display case is sealed in its entirety and can be opened through one single transparent front door with a key (FIG. 2) (21) that will be used solely by the product restocker for purposes of his/her job. There will be a dispenser on each hook FIG. 1 (13) consisting of a rectangular car that will use a projecting pulley FIGS. 1 and 3 (14) to cause a blister pack of the chosen product FIG. 1 (15) to fall onto a slide below FIG. 1 (16) that will slide it directly to the cashier's counter through a special hole in the door (the pulley is pulled outwards).

Figure 3B:
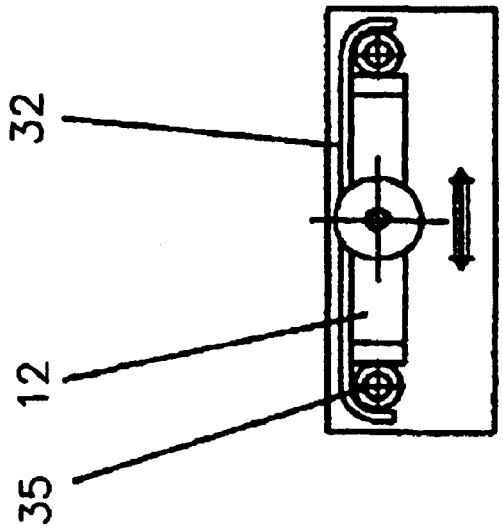
FIG. 3 represents side and frontal views of the manual dispenser.
Figure 3A:
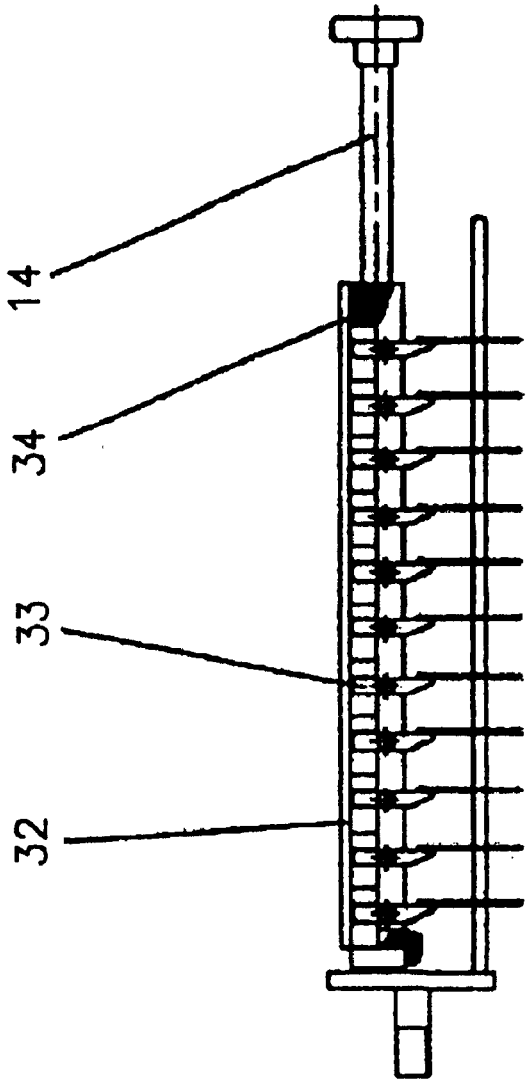
Figure 4B:
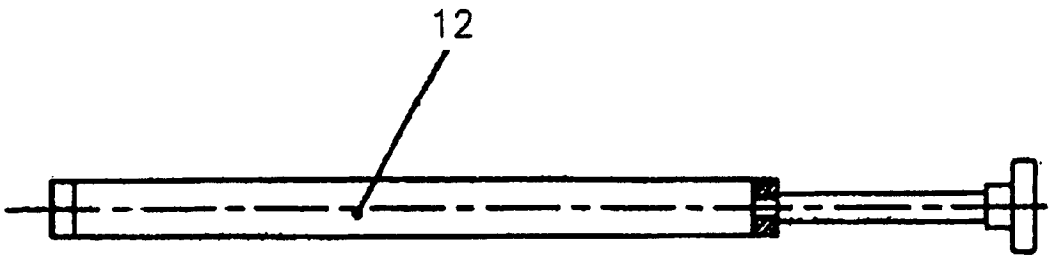
FIG. 4 represents frontal, side and upper views of the manual dispenser car.
Figure 4C:
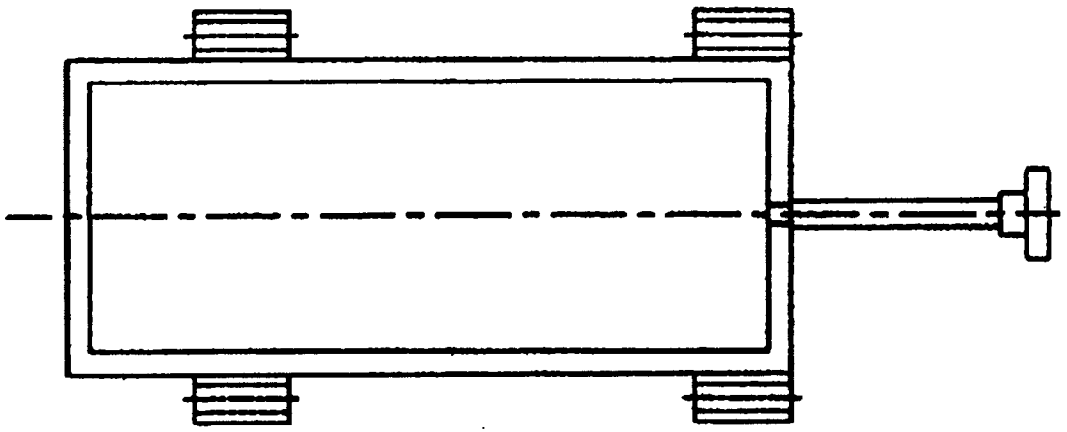
Figure 4A:
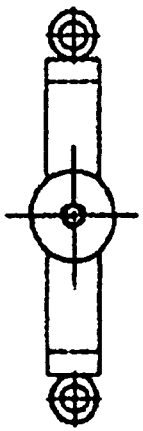
Figure 9B:
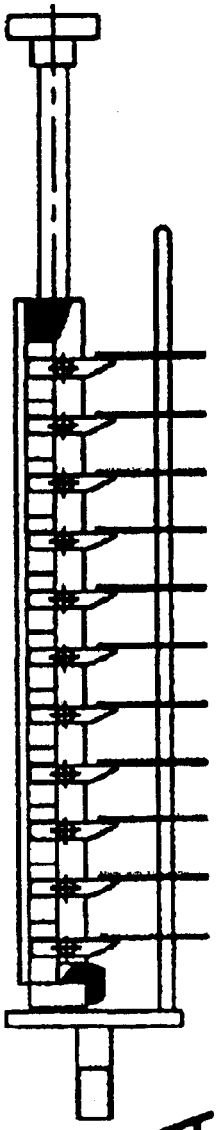
FIG. 9 shows the dispenser system assembly.
Figure 9C:
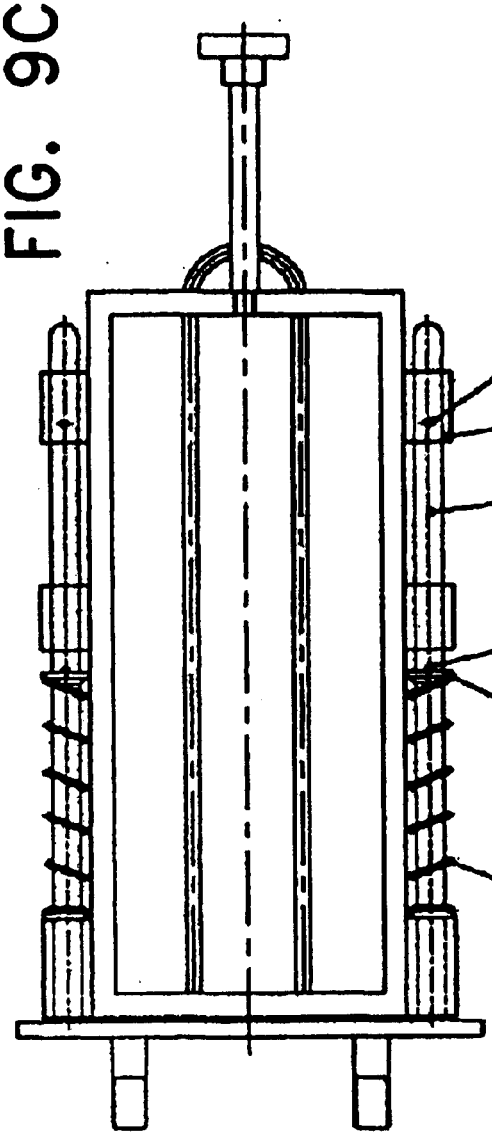
Figure 9A:
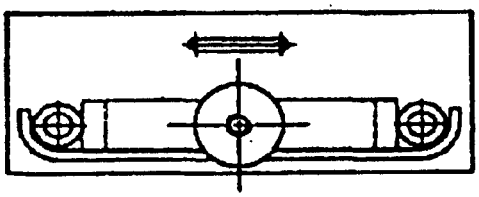

The dispenser car FIGS. 1, 3, 4 (12) slides along two sets of skids on the back of the display case FIG. 9 (37). Two springs FIG. 9 (91) are installed on these skids, centered by two centering bushings FIG. 9 (92). Each spring is restricted by a head FIG. 9 (93) on the skids.

When the car is moved backwards by the oscillating blades located in the lower part FIG. 3 (33), it will be in position to dispense a new blister pack.

The dispenser car will be located on the hook so that the blades can carry the blister pack from the upper cardboard portion that remains above the hook.

Figure 5C:
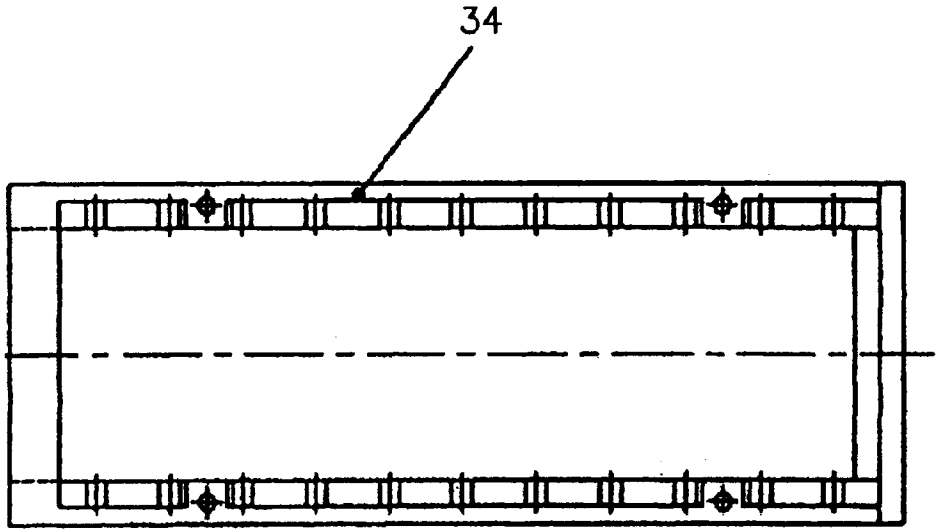
FIG. 5 represents frontal, side and upper views of the framework of the blade case.
Figure 5B:
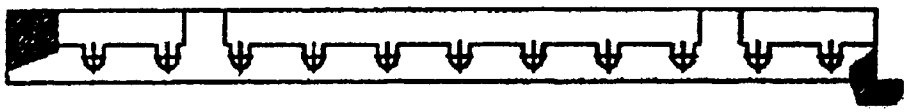
Figure 5A:
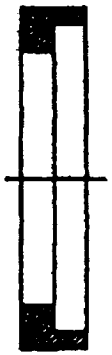
Figure 6A:
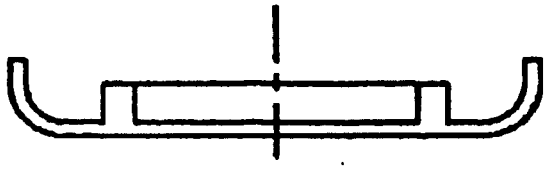
FIG. 6 represents frontal, side and upper views of the lid of the case frame .
Figure 6B:
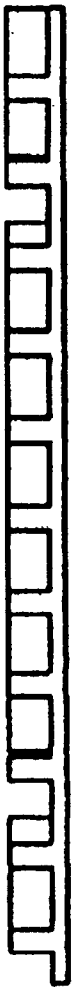
Figure 6C:
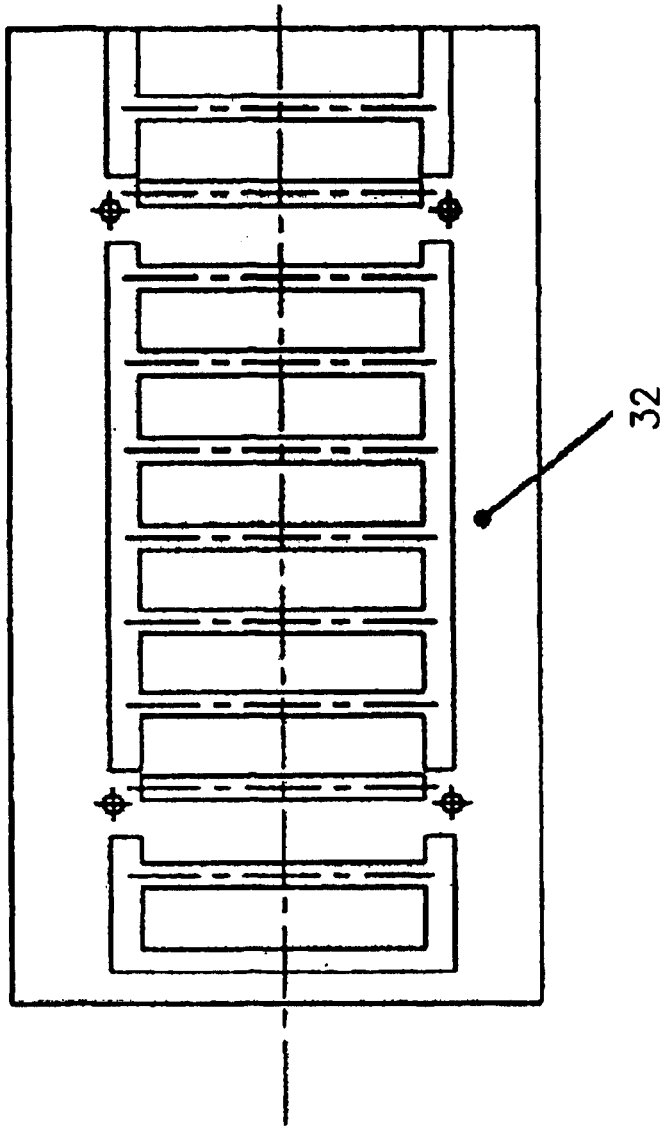
Figure 7A:
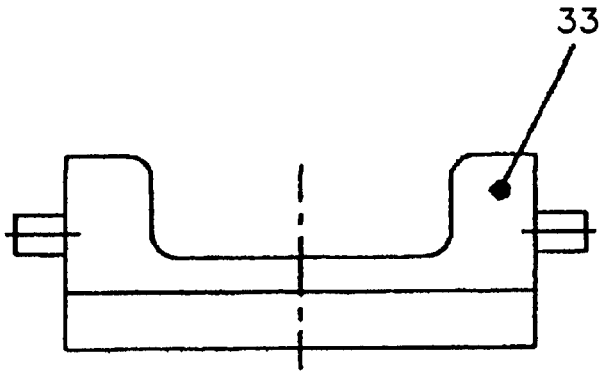
FIG. 7 shows frontal and side views of the blade.
Figure 7B:
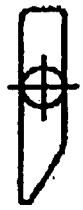
Figures 8A, 8B, 8C, 8D:
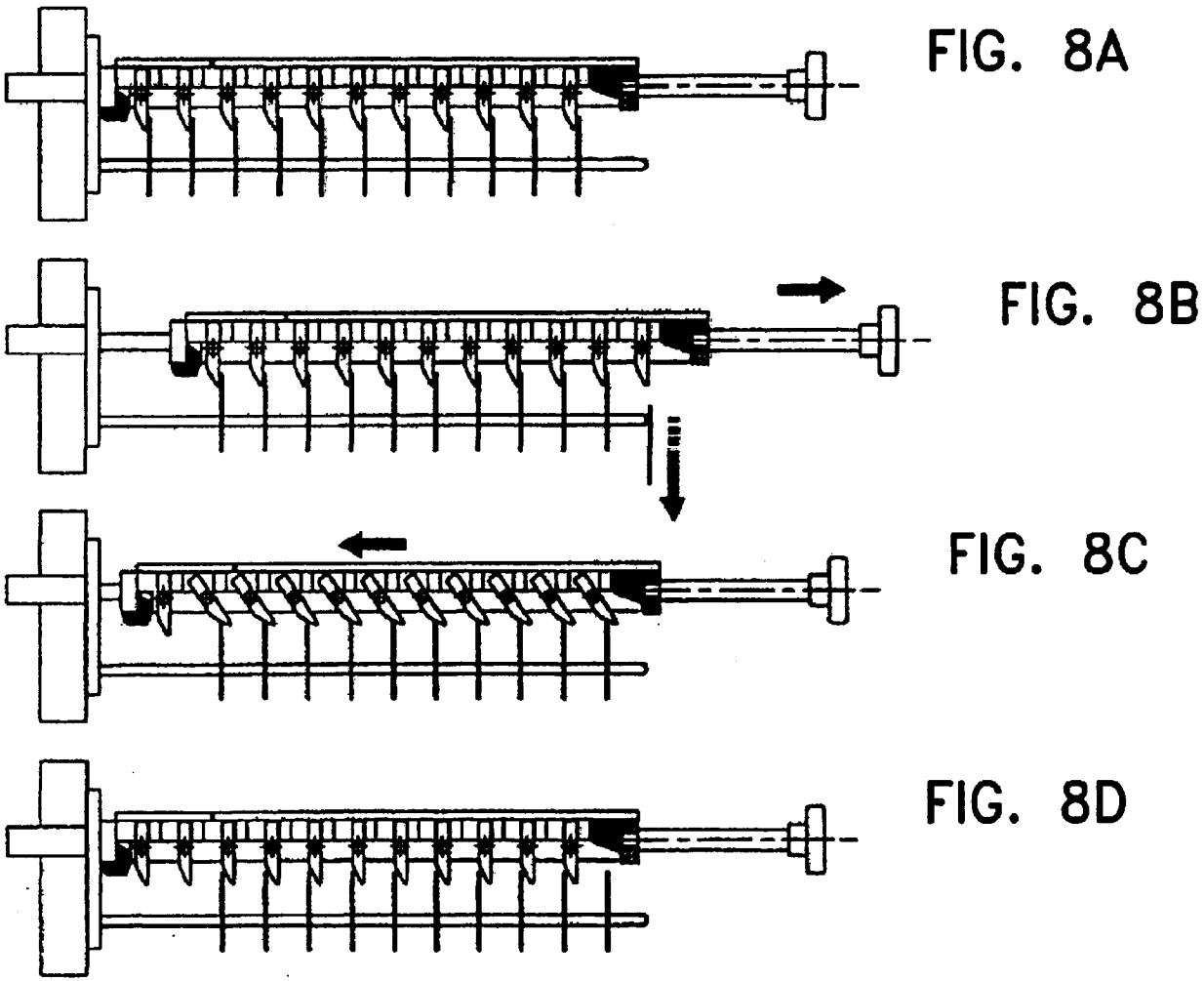
FIG. 8 shows four views that display the blister pack operation or discharge.

The car may have different numbers of blades depending on the thickness of the blister pack because of the product it contains, in direct proportion to the space it may occupy in the established location. The car is comprised of an exterior frame FIGS. 3, 4 (12) that has 4 fixed bushings FIG. 3 (35) that slide along the skids FIG. 9 (37). A piece comprised by another frame with a case for the mobile blades FIGS. 3, 5 (34) is set on this frame and a lid to keep the blades in position FIGS. 3, 6 (32). This lid will be affixed to the case frame. The frame will be limited in its movement by two bushings at the end of the skids affixed by a lynchpin FIG. 9 (95). The bushing will have a hole for the lynchpin displaced towards one end to change the movement of the car depending on the thickness of the blister pack. It will suffice to invert the position of this bushing FIG. 9 (94) to limit the movement of the car according to the thickness of the blister pack. This composite piece will be free and may be removed from above by the restocker to load and put the hook in order. The blades can be turned for oscillation FIGS. 3, 7 (33).

The car can hold the number of blades that is deemed necessary according to the width of the cabinet and the type of product to be displayed and dispensed.

What is claimed is:

1. A blister pack hook display case with a manual security dispensing system comprised of a display case with a transparent door and lock that has a blister pack dispenser on each hook, CHARACTERIZED in that the dispenser dispenses a blister pack each time a pulley located in the front is pulled; will dispense the chosen blister through the transparent door, which will reach the cashier for payment and withdrawal by means of a slide below; a car dispensing the blister packs has a number of blades depending on the space available and the size of the blister pack that oscillates forward only to raise paddles when the car is released backwards without moving the next blister pack backward; they then fall into position to dispense a new blister pack; the blades do not oscillate backwards so that when it is pulled forward, the first blister pack is moved until it falls off the hook and all others then move one step forward to continue the sequence.

2. A blister pack hook display case with a manual security dispensing system according to claim No. 1, CHARACTERIZED in that each hook has a manual dispenser.

3. A blister pack hook display case with a manual security dispensing system according to claim No. 1, CHARACTERIZED in that each dispenser has an independent car that slides along skids affixed to the support.

4. A blister pack hook display case with a manual security dispensing system according to claim No. 1, CHARACTERIZED in that it has another piece comprised of a case frame for oscillating blades and a lid to keep the blades in their position inside the car.

5. A blister pack hook display case with a manual security dispensing system according to claim No. 1, CHARACTERIZED in that the composite piece fits in any of the display case cars.

6. A blister pack hook display case with a manual security dispensing system according to claim No. 1, CHARACTERIZED in that the composite piece carrying the blades is loose and can be raised with one hand to load the hook.

7. A blister pack hook display case with a manual security dispensing system according to claim No. 1, CHARACTERIZED in that the mobile blades do not oscillate backwards in order to move all blister packs to a forward position and dispense the blister pack in the first position while it oscillates forward when the car moves backwards to allow each blade to resume a new position with the next blister pack.

8. A blister pack hook display case with a manual security dispensing system according to claim No. 1, CHARACTERIZED in that the second row of hooks are alternated with the upper ones to allow the blister packs from above to fall.

9. A blister pack hook display case with a manual security dispensing system according to claim No. 1, CHARACTERIZED in that the transparent door has a hole in front of each dispenser to allow the pulley of the dispensing car to pass through it when the door is opened and closed to restock the merchandise, thus leaving the pulley available to the public.

10. A blister pack hook display case with a manual security dispensing system according to claim No. 1, CHARACTERIZED in that the front end of the skids has two bushings fixed with a lynchpin to limit the movement of the car according to the thickness of the blister pack to be dispensed.

11. A blister pack hook display case with a manual security dispensing system according to claim No. 1, CHARACTERIZED in that the car blades have two pivots for oscillation and their bulk is visibly loaded on one end in order for gravity to remain vertical at all times.

12. A blister pack hook display case with a manual security dispensing system according to claim No. 1, CHARACTERIZED in that each dispenser has a mechanical spring located behind the cabinet connected to each car by a bar through the support or two springs mounted on the skids located on the sides of each car, which makes the car return to its original position once pulled by the user or customer, although it can be replaced by an electrical or winding device.

13. A blister pack hook display case with a manual security dispensing system according to claim No. 1, CHARACTERIZED in that blister pack hook assembly has notches (as many as there are blades in the car) so that the restocker can place the blister packs in exactly the right position for the blades to move them in orderly fashion.

* * * * *